US006461195B2

(12) United States Patent
Chang

(10) Patent No.: US 6,461,195 B2
(45) Date of Patent: Oct. 8, 2002

(54) SAFETY ELECTRIC PLUG WITH OVERCURRENT PROTECTIVE MEANS

(76) Inventor: Min-Chen Chang, No. 163, Ta-Chou Rd., Shen-Kang Hsang, Tai-Chung Hsien (TW)

( * ) Notice: Subject to any disclaimer, the term of this patent is extended or adjusted under 35 U.S.C. 154(b) by 0 days.

(21) Appl. No.: 09/803,559

(22) Filed: Mar. 12, 2001

(65) Prior Publication Data

US 2002/0127917 A1 Sep. 12, 2002

(51) Int. Cl.[7] ..... H01R 13/68
(52) U.S. Cl. ..... 439/622; 439/145; 200/51 R
(58) Field of Search ..... 439/622, 620, 439/621, 188, 143, 145; 200/51.12, 51 R

(56) References Cited

U.S. PATENT DOCUMENTS 5,643,012 A * 7/1997 Mai et al. ..... 439/622
5,791,941 A * 8/1998 Wang ..... 439/622
5,851,127 A * 12/1998 Huang ..... 439/622
5,876,250 A * 3/1999 Deng ..... 439/622
5,906,515 A * 5/1999 Lin ..... 439/622

* cited by examiner

*Primary Examiner*—Hien Vu
(74) *Attorney, Agent, or Firm*—Charles E. Baxley

(57) ABSTRACT

A safety electric plug is constructed to include a negative pole metal blade connected to the negative pole of power supply, a positive pole metal blade, a bimetal contact member connected to the positive pole of power supply and disposed in contact with the positive pole metal blade, the bimetal contact member curving backwards from the positive pole metal blade to open the circuit upon an overcurrent, a spring member, and a sliding partition plate supported on the spring member and adapted to keep the bimetal contact member away from the positive pole metal blade after deformation of the bimetal contact member due to an overcurrent.

8 Claims, 5 Drawing Sheets

SAFETY ELECTRIC PLUG WITH OVERCURRENT PROTECTIVE MEANS

BACKGROUND OF THE INVENTION

The present invention relates to en electric plug and, more particularly to a safety electric plug, which has overcurrent protective means.

Following prosperity of the society, the living standard of human beings has been greatly improved, and a variety of electric home and office appliances (such as TV set, refrigerator, electric cooker, computer, and etc.) are intensively used. Electric appliances must be carefully used. An improper use of electric appliances may cause an overcurrent, resulting in great suffering or ruin. There are commercially available extension cables with auto circuit breaker. However, these extension cables with auto circuit breaker are commonly expensive. Further, it is inconvenient to use electric appliances with an extension cable with auto circuit breaker due to installation space and cable length limitations.

SUMMARY OF THE INVENTION

The present invention has been accomplished under the circumstances in view. According to one aspect of the present invention the safety electric plug has a special design of electrically insulative sliding partition plate, which enables a bimetal contact member to automatically trip off from the positive pole metal blade and to cut off the circuit upon an overcurrent, and a spring member, which automatically forces the electrically insulative sliding partition plate outwards to completely isolate the bimetal contact member from the positive pole metal blade after the bimetal contact member tripped off. According to another aspect of the present invention, the reset of the circuit is simply done by pushing the electrically insulative sliding partition plate back to its former position. The use of the safety electric plug eliminates the necessity of an expensive extension cable with automatic circuit breaker.

DETAILED DESCRIPTION OF THE PREFERRED EMBODIMENT

Figure 1:
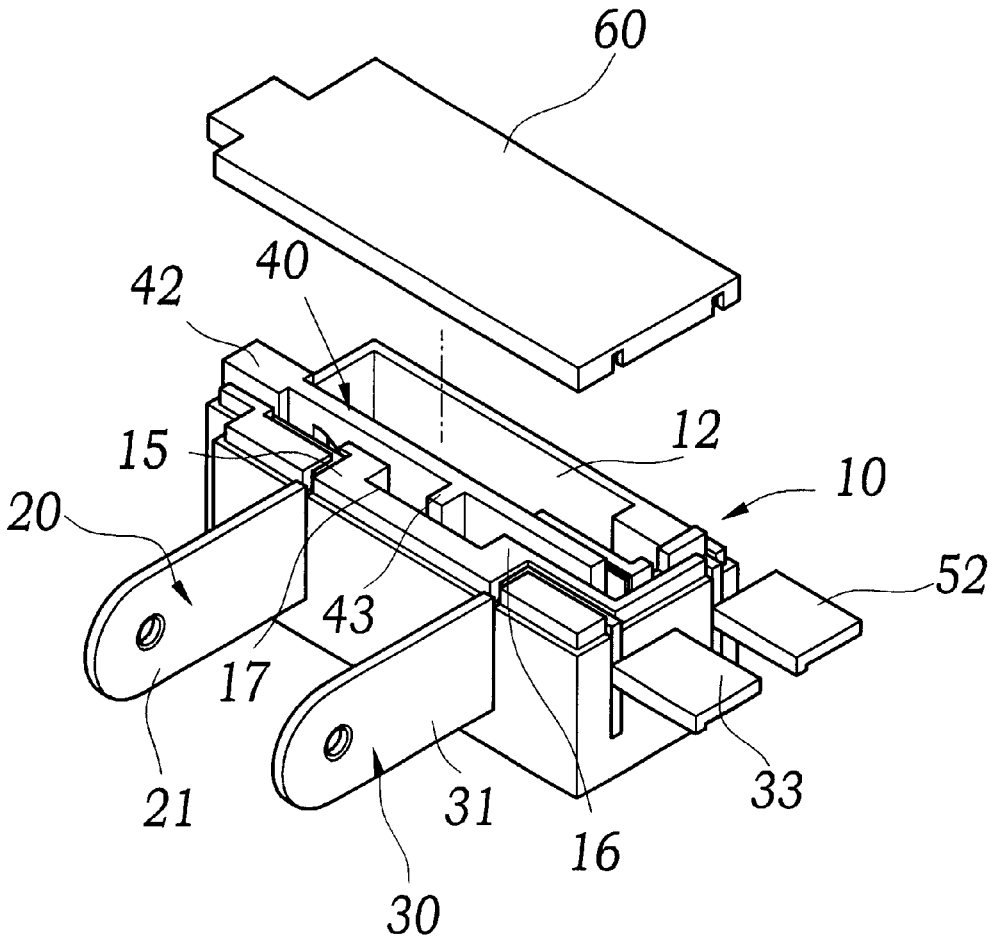
FIG. 1 is an assembly view of the present invention before installation of the top cover plate.
Figure 2:
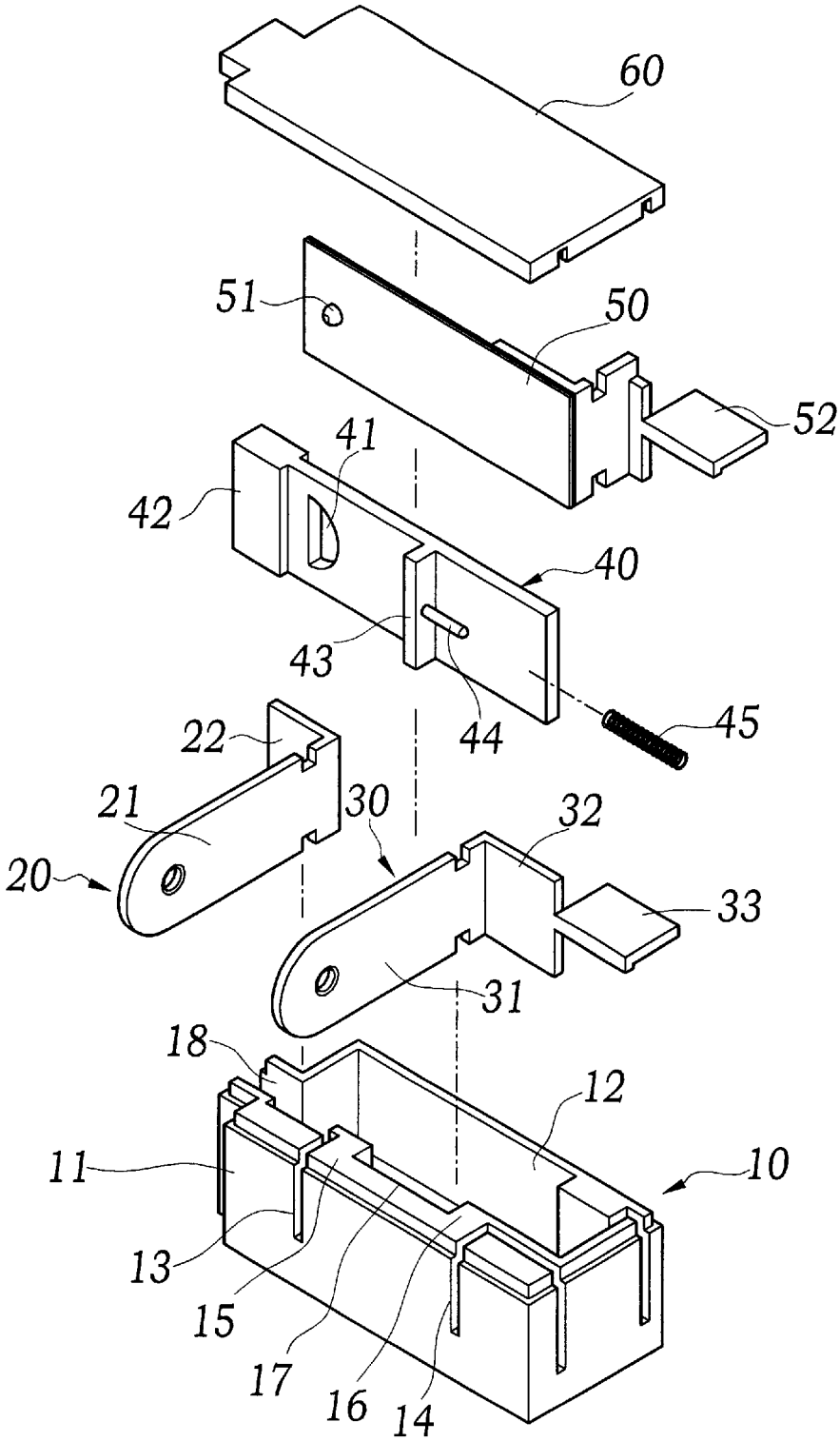
FIG. 2 is an exploded view of the resent invention.
Figure 3:
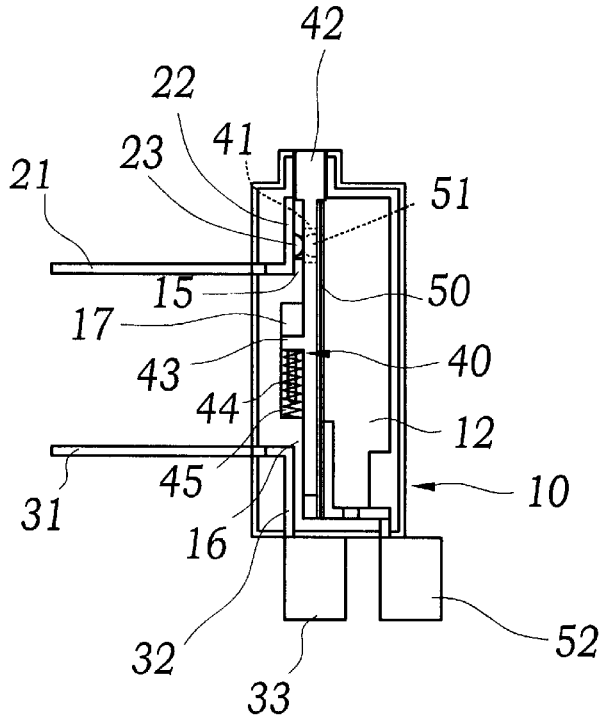
FIG. 3 is a plain view of the present invention.

Referring to FIGS. 1, 2 and 3, a safety electric plug in accordance with the present invention is shown comprised of a housing 10, a positive pole metal blade 20, a negative pole metal blade 30, an electrically insulative partition plate 40, a spring member 45, a bimetal contact member 50. and a top cover plate 60.

Figure 5:
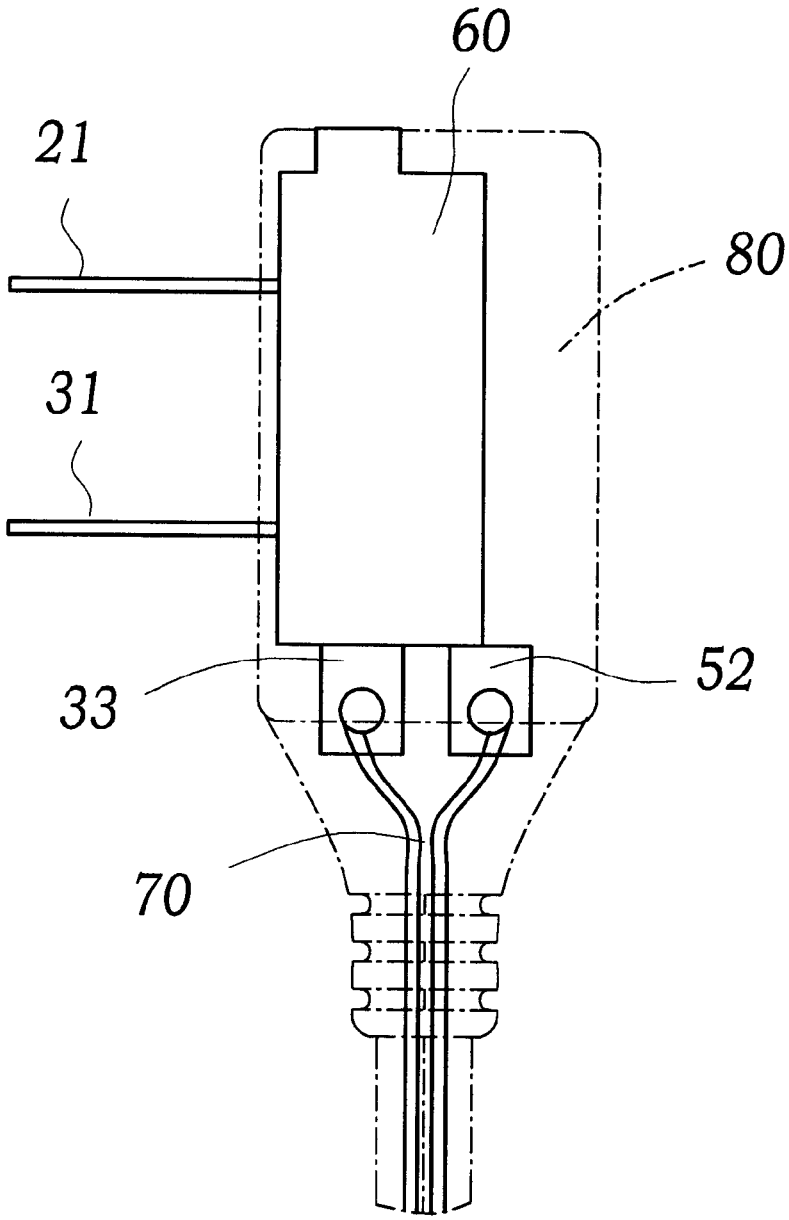
FIG. 5 is a schematic drawing showing the outer shell molded on the inner shell and the top cover plate according to the present invention.

The housing 10 comprises a substantially rectangular, top-open inner shell 11 made of electrically insulative material and defining a receiving chamber 12. The inner shell 11 comprises two vertical insertion slots 13 and 14 vertically extended through the front sidewall thereof and arranged in parallel, two vertical spacer blocks 15 and 16 of L-shaped profile formed integral with the inner surface of the front sidewall between the vertical insertion slots 13 and 14 and respectively extended along the vertical insertion slots 13 and 14, and an end hole 18 extended through one lateral sidewall thereof. The spacer blocks 15 and 16 define a displacement chamber 17 within the inner shell 11. The positive pole metal blade 20 is mounted in the inner shell 11, comprising a front plug portion 21 extended out of one vertical insertion slot 13 of the inner shell 11, a rear contact portion 23 suspended in the receiving chamber 12 of the housing 10, and an angled retaining portion 22 connected between the front plug portion 21 and the rear contact portion 23 and fastened to one spacer block 15 of the inner shell 11. The negative pole metal blade 30 is mounted in the inner shell 11, comprising a front plug portion 31 extended out of the other vertical insertion slot 14 of the inner shell 11, a rear connecting portion 33 suspended in the receiving chamber 12 of the housing 10 and connected to negative terminal of the electric wire 70 being fixedly fastened to the housing 10 (see also FIG. 5), and an angled retaining portion 32 connected between the front plug portion 31 and the rear connecting portion 33 and fastened to the other spacer block 16 of the inner shell 11. The electrically insulative partition plate 40 is mounted inside the housing 10 between the receiving chamber 12 and the displacement chamber 17, comprising a through hole 41 aimed at the rear contact portion 23 of the positive pole metal blade 20, a press head 42 disposed at one end thereof and inserted into the end hole 18 of the inner shell 11, a vertical block 43 disposed at the front side thereof and moved with the electrically insulative partition plate 40 in the displacement space 17 inside the inner shell 11, and a horizontal locating pin 44 perpendicularly extended from one side of the vertical block 43. The bimetal contact member 50 is formed of two metal plates of different coefficient of extension abutted together, having a contact 51 disposed at one end thereof and inserted through the through hole 41 of the electrically insulative partition plate 40 into contact with the rear contact portion 23 of the positive pole metal blade 20, and a connecting tip 52 disposed at an opposite end thereof and connected to the positive terminal of the electric wire 70. The spring member 45 is mounted on the locating pin 44 of the electrically insulative partition plate 40 within the displacement space 17 and stopped against one spacer block 16 of the inner shell 11 to impart an outward pressure to the electrically insulative partition plate 40 in direction toward the end hole 18 of the inner shell 11. The top cover plate 60 is covered on the inner shell 11. After the top cover plate 60 has been closed on the inner shell 11, an outer shell 80 is molded from a resin on the inner shell 11 and the top cover plate 60 (see FIG. 5). The outer shell 80 does not block the end hole 18 of the inner shell 11.

Figure 4A:
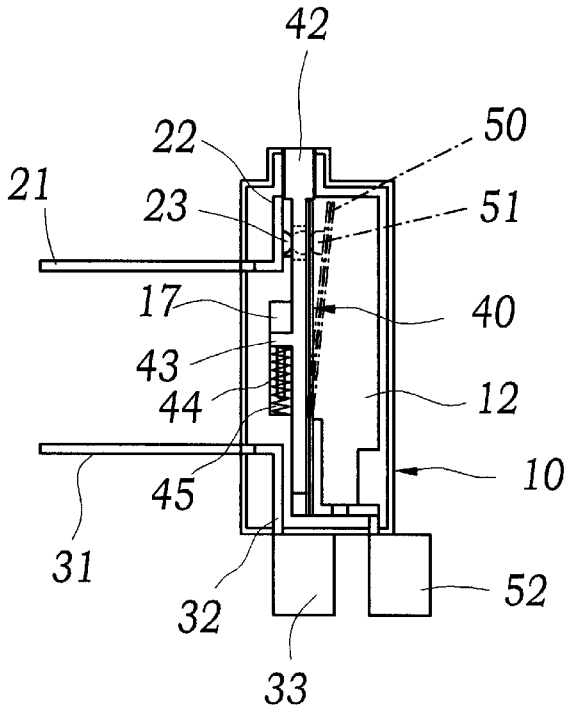
FIG. 4A illustrates the operation of the present invention (I).
Figure 4B:
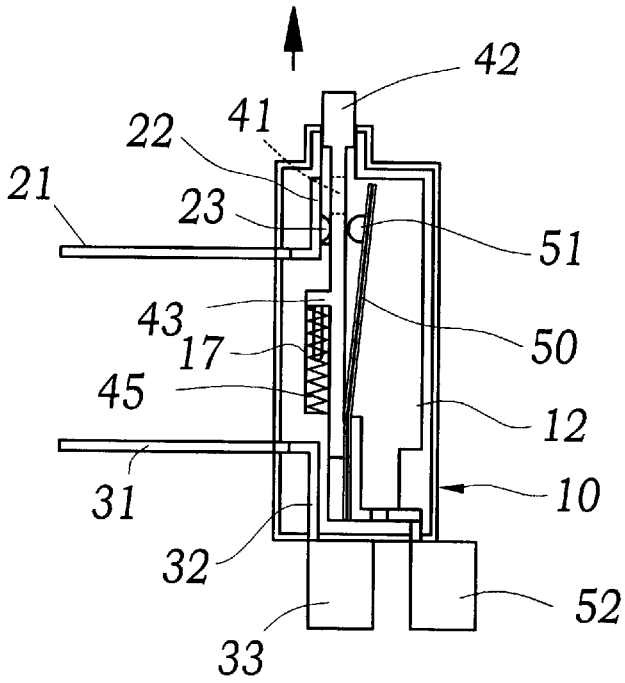
FIG. 4B illustrates the operation of the present invention (II).

Referring to FIGS. 4A and 4B. when an overcurrent occurs, the bimetal contact member 50 is caused to curve backwards by heat, and to disengage the contact 51 from the rear contact portion 23 of the positive pole metal blade 20, and therefore the circuit is off (see FIG. 4A). After disconnection of the contact 51 of the bimetal contact member 50 from the rear contact portion 23 of the positive pole metal blade 20, the electrically insulative partition plate 40 is released from the constraint of the contact 51 of the bimetal contact member 50 and forced outwards by the spring member 45 to keep the contact 51 from contacting the positive pole metal blade 20 (see FIG. 4B).

Figure 4C:
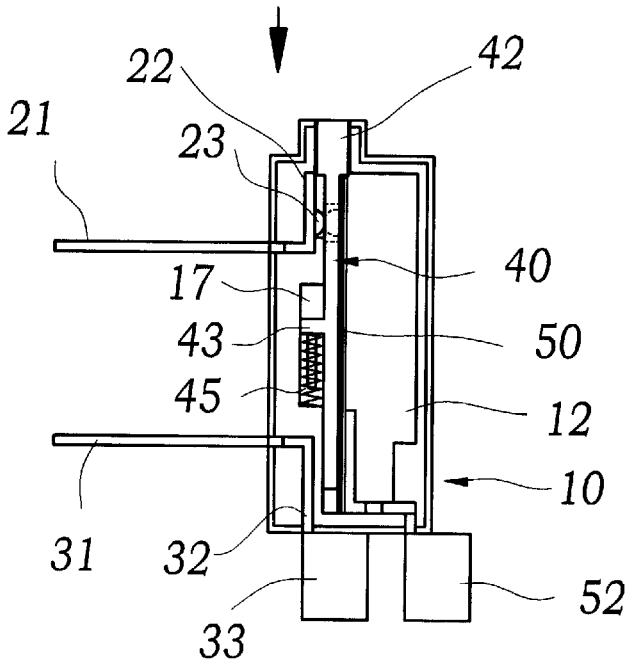
FIG. 4C illustrates the operation of the present invention (III).

After the temperature of the bimetal contact member 50 has been dropped and the bimetal contact member 50 has returned to its former shape, the user can then push the press head 42 of the electrically insulative partition plate 40 inwards to let the contact 51 be forced forwards through the through hole 41 of the electrically insulative partition plate 40 into contact with the rear contact portion 23 of the positive pole metal blade 20 by the spring power of the bimetal contact member 50 (see FIG. 4C), and therefore the circuit is electrically connected again.

While only one embodiment of the present invention has been shown and described, it will be understood that various modifications and changes could be made thereunto without departing from the spirit and scope of the invention disclosed.

What the invention claimed is:

1. A safety electric plug, comprising:

a) an inner shell, said inner shell comprising a receiving chamber, a first insertion slot and a second insertion slot extended through a front sidewall thereof and arranged in parallel;

b) a positive pole metal blade mounted in said first insertion slot, said positive pole metal blade comprising a front plug portion extended out of said inner shell and an angled retaining portion positioned inside said inner shell;

c) a negative pole metal blade mounted in said second insertion slot, said negative pole metal blade comprising a front plug portion extended out of said inner shell, and an angled retaining portion positioned inside said inner shell and connected to a negative pole of a power supply;

d) a bimetal contact member mounted inside the receiving chamber of said inner shell, said bimetal contact member having a fixed end and connected to a positive pole of the power supply and a free end adapted to contact said positive pole metal blade;

e) an insulative partition plate mounted in the receiving chamber of said inner shell and moved between a first position where the free end of said bimetal contact member is allowed to contact said positive pole metal blade, and a second position where said insulative partition plate stop said bimetal contact member from touching said positive pole metal blade;

f) a top cover plate covered on said inner shell to close said receiving chamber;

wherein said inner shell comprises a first spacer block adapted to hold the retaining portion of said positive pole metal blade, and a second spacer block adapted to hold the retaining portion of said negative pole metal blade;

wherein said first spacer block and said second spacer block define a displacement space inside said inner shell; and wherein said insulative partition plate comprises a vertical block disposed at a front side thereof and suspended in the displacement space of said inner shell; and g) a spring member suspended in said displacement space and connected between said second spacer block and a locating pin at said vertical block of said insulative partition plate to force said insulative partition plate from said first position toward said second position.

2. The safety electric plug of claim 1, wherein said inner shell is molded from insulative plastics.

3. The safety electric plug of claim 1, wherein said inner shell comprises an end hole adapted to receive one end of said insulative partition plate.

4. The safety electric plug of claim 1, wherein said positive pole metal blade further comprises a rear contact portion extended from the retaining portion thereof and adapted to contact the free end of said bimetal contact member.

5. The safety electric plug of claim 1, wherein said insulative partition plate has a through hole through which a part of the free end of said bimetal contact member is inserted into contact with said positive pole metal blade after said insulative partition plate has been moved to said first position.

6. The safety electric plug of claim 1, wherein said bimetal contact member is comprised of two metal plates of different coefficient of extension abutted together.

7. The safety electric plug of claim 5, wherein said bimetal contact member comprises a contact raised from the free end thereof, which is inserted through the through hole of said insulative partition plate into contact with said positive pole metal blade at room temperature after said insulative partition plate has been moved from said second position to said first position.

8. A safety electric plug, comprising:

a) an inner shell, said inner shell comprising a receiving chamber, a first insertion slot and a second insertion slot extended through a front sidewall thereof and arranged in parallel;

b) a positive pole metal blade mounted in said first insertion slot, said positive pole metal blade comprising a front plug portion extended out of said inner shell and an angled retaining portion positioned inside said inner shell;

c) a negative pole metal blade mounted in said second insertion slot, said negative pole metal blade comprising a front plug portion extended out of said inner shell, and an angled retaining portion positioned inside said inner shell and connected to a negative pole of a power supply;

d) a bimetal contact member mounted inside the receiving chamber of said inner shell, said bimetal contact member having a fixed end and connected to a positive pole of the power supply and a free end adapted to contact said positive pole metal blade;

e) an insulative partition plate mounted in the receiving chamber of said inner shell and moved between a first position where the free end of said bimetal contact member is allowed to contact said positive pole metal blade, and a second position where said insulative partition plate stop said bimetal contact member from touching said positive pole metal blade; and f) a top cover plate covered on said inner shell to close said receiving chamber;

wherein said insulative partition plate has a through hole through which a part of the free end of said bimetal contact member is inserted into contact with said positive pole metal blade after said insulative partition plate has been moved to said first position; and wherein said bimetal contact member comprises a contact raised from the free end thereof, which is inserted through the through hole of said insulative partition plate into contact with said positive pole metal blade at room temperature after said insulative partition plate has been moved from said second position to said first position.

* * * * *